United States Patent [19]

Cheng

[11] Patent Number: 4,616,807

[45] Date of Patent: Oct. 14, 1986

[54] MOLDING JACK BASE

[76] Inventor: Tsung-Hua Cheng, P.O. Box 10160, Taipei, Taiwan

[21] Appl. No.: 721,223

[22] Filed: Apr. 8, 1985

[51] Int. Cl.[4] ..... B66F 3/24

[52] U.S. Cl. ..... 254/93 H

[58] Field of Search ..... 254/93 H, 93 R; 264/261, 263

[56] References Cited

U.S. PATENT DOCUMENTS

| | | | |
|---|---|---|---|
| 3,315,343 | 4/1967 | Berg | 254/93 R |
| 3,829,063 | 8/1974 | Holzworth | 254/93 R |
| 3,896,199 | 7/1975 | Michaelis | 264/263 |
| 4,021,018 | 5/1977 | Dasan | 254/93 H |
| 4,077,608 | 3/1978 | Nehrig | 254/93 H |

*Primary Examiner*—Robert C. Watson

[57] ABSTRACT

A jack base is a plastic base by directly molding on the lower portion of a hydraulic pump, a hydraulic cylinder and a hydraulic oil conduit connected between the pump and the cylinder so as to form an integrated jack.

2 Claims, 5 Drawing Figures

MOLDING JACK BASE

BACKGROUND OF THE INVENTION

Conventional jack is made by fixing a hydraulic pump and a hydraulic cylinder into a base of cast iron, which however has the following defects:

1. It is easy to produce holes in the casting base so that the holes may easily break the casting.
2. During the drilling processing for hydraulic oil conduit, the scrap or dust of casting may carry static electricity to adhere on the conduit wall which may scratch the sealing ring and cause leakage of hydraulic system of the jack.
3. When drilling the hydraulic holes either horizontal or vertical hole, it takes longer time for drilling such holes and it still requires the welding procedure to blind the unnecessary hole.
4. The casting is fragile and is easily broken or damaged during handling and uses.
5. Whenever drilling the holes, it may waste the casting material if the drilling precision is not allowed.
6. The check valves provided in the hydraulic oil passage is processed within the casting base in a difficult way since such a "piping system" can not be installed outside the casting base.

The present inventor has found the defects of conventional jack and invented the molding jack base.

SUMMARY OF THE INVENTION

The object of the present invention is to provide a molding jack base by fitting the hydraulic pump, in combination with the hydraulic cylinder and the hydraulic oil conduit into a pre-formed plastic base and by further filling a resin binder into the pre-formed base so as to sturdily bind the jack with the base as an integrated body.

Another object of the present invention is to provide a jack base by directly molding a plastic base on the lower portion of the hydraulic cylinder, the hydraulic pump and the oil conduit connected therebetween.

DETAILED DESCRIPTION

Figure 1:
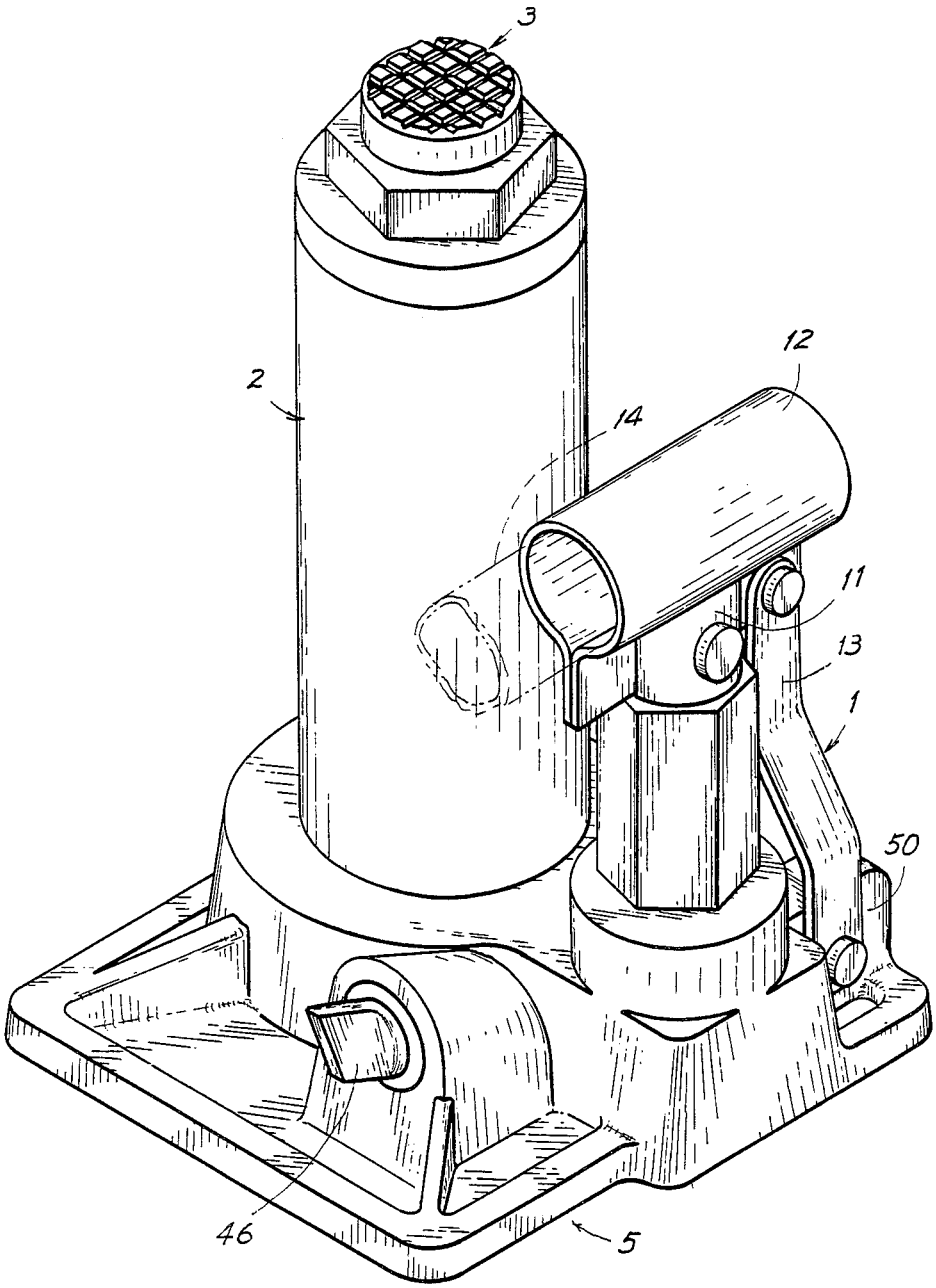
FIG. 1 is a perspective drawing of the present invention.
Figure 2:
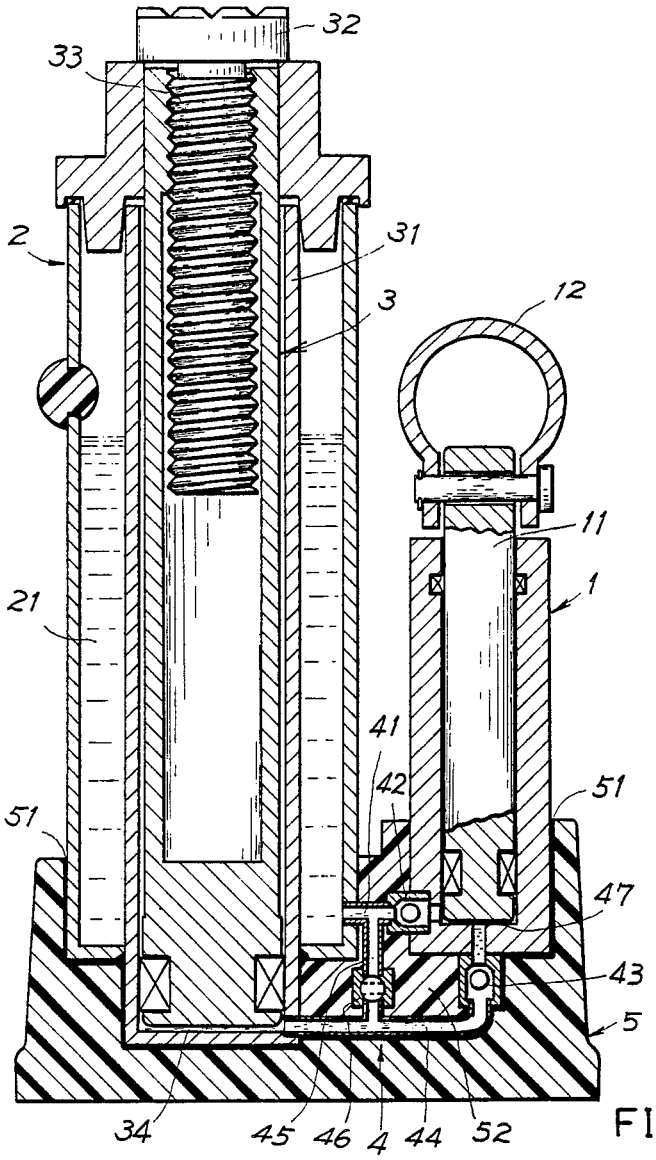
FIG. 2 is a sectional elevation of the present invention.
Figure 3:
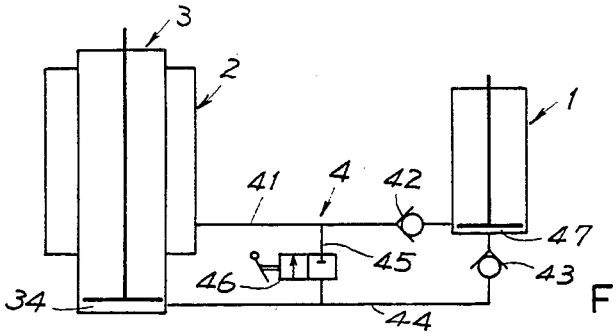
FIG. 3 is an illustration showing the hydraulic system in accordance with the present invention.

As shown in FIGS. 1, 2 and 3, the present invention comprises a molding jack base 5 adapted on the lower portion of a hydraulic pump 1 and a hydraulic cylinder 2 for filling the void as occupied by the hydraulic oil conduit 4.

The hydraulic pump 1 includes a plunger 11, a sleeve pipe 12 pivotedly connected atop on the plunger 11, a link 13 pivotedly formed on the link base 50 and an operating rod 14 fitted into sleeve pipe 12.

The hydraulic cylinder 2 is formed with a jacket 21 for storing hydraulic oil and formed with an inner cylinder 31 for movably operating the piston 3 having a threaded hole 33 to fix a top rod 32.

The hydraulic oil conduit 4 comprises: an upper tube 41 transversely connected between the jacket 21 and the bottom 47 of pump 1 and formed with a check valve 42 to stop backflow of hydraulic oil from the pump 1 to the jacket 21, a lower tube 44 transversely connected between the bottom 34 of cylinder 31 and bottom 47 of pump 1 and formed with a check valve 43 to stop backflow of oil from cylinder 31 to pump 1 and a side pipe 45 vertically connected between tube 41 and tube 44 and formed with a control valve 46.

The jack base 5 is preformed by plastic molding process to form a socket 51 adapted for the lower portion of hydraulic pump 1 and cylinder 3, fitted in socket 51 of base 5. A binder 52 such as an emulsion type resin of polyvinyl chloride (PVC) is filled into the socket 51 of plastic base 5 which may be made from PVC. After heating and curing, the binder 52 will be sturdily bound with base 5 in combination with cylinder 3, pump 1 and conduit 4. The void or space occupied by original tubes 41, 44, 45 and valves 42, 43, 46 is then filled by binder 52. The cylinder 3, pump 1 and conduit 4 are then formed as an integrated body.

Figure 4:
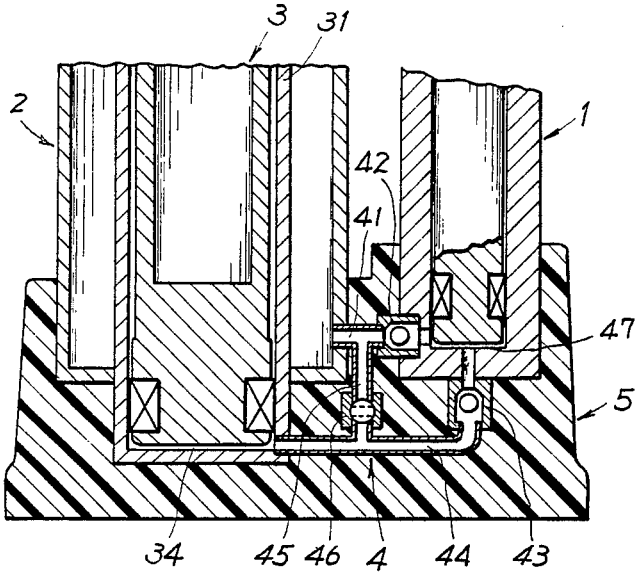
FIG. 4 is another preferred embodiment of the present invention.

Another preferred embodiment of the present invention is shown in FIG. 4 in which the binder 52 as aforementioned is omitted and the lower portion of cylinder 3, pump 1 and conduit 4 are directly molded with a plastic resin, such as polypropylene to sturdily bind cylinder 3, pump 1 and conduit 4 as an integrated body.

Figure 5:
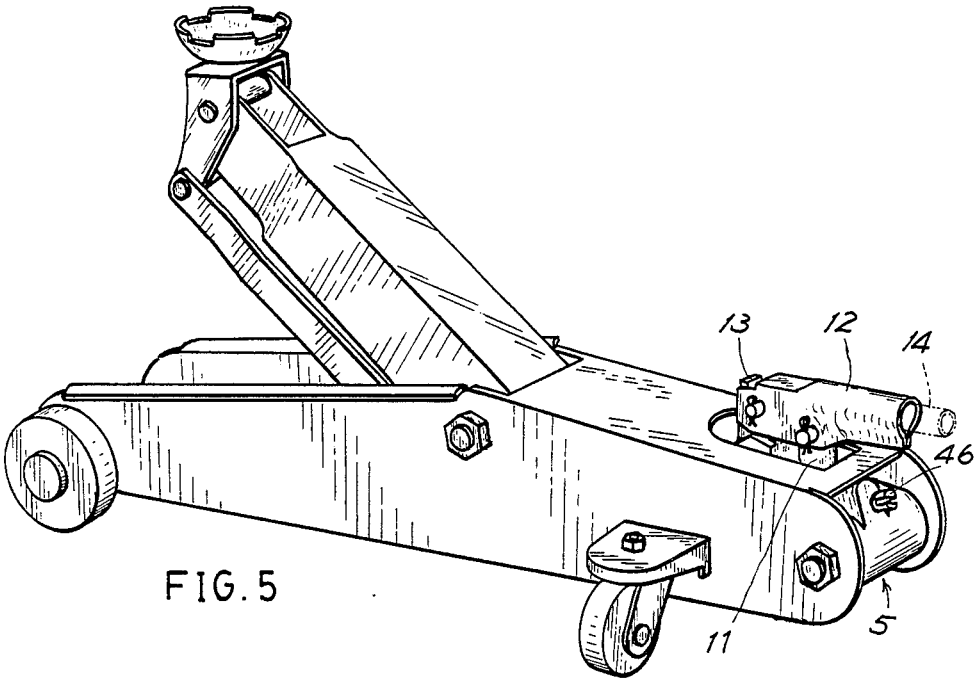
FIG. 5 shows another application in accordance with the present invention.

The vertical jack as shown in FIG. 1 may be modified as the laid-down type as shown in FIG. 5.

The present invention has the following advantages superior to conventional jacks:

1. The hydraulic conduit 4 is made of high-pressure tubes to prevent from leakage or breaking as found in conventional casting base.
2. There is no need to drill the hydraulic oil as needed in a a conventional jack base so that the fabrication procedure is simplified and the production cost can be saved.
3. The plastic molding base is stronger, durable and even beautiful than the conventional jack with casting base. The molding process will reduce the production cost and increase the production rate for mass production.

I claim:

1. A jack base comprisng a preformed plastic base having a socket adapted for the lower portion of a hydraulic cylinder and a hydraulic pump of a jack having a hydraulic oil conduit connected between said pump and said cylinder, said lower portion of said cylinder and said pump connected with said hydraulic oil conduit, which includes an upper tube transversely connected between the jacket of said hydraulic cylinder and the bottom of said hydraulic pump and formed with a check valve therebetween, a lower tube transversely connected between the bottom of said cylinder and the bottom of said pump and formed with a check valve therebetween, and a side pipe vertically connected between said upper tube and said lower tube and formed with a control valve therebetween, being fitted into said socket of said preformed plastic base and a resin binder being further filled into said socket and heated, cured so as to sturdily bind said binder with said preformed base in combination with said lower portion of said cylinder and said pump, and said conduit to form an integrated body.

2. A jack base according to claim 1, wherein said preformed base is made from polyvinyl chloride and said binder is an emulsion type resin of polyvinyl chloride.

* * * * *